US009717285B2

(12) United States Patent
Stolkin

(10) Patent No.: US 9,717,285 B2
(45) Date of Patent: Aug. 1, 2017

(54) GARMENT

(71) Applicant: Suzannah Stolkin, London (GB)

(72) Inventor: Suzannah Stolkin, London (GB)

( * ) Notice: Subject to any disclaimer, the term of this patent is extended or adjusted under 35 U.S.C. 154(b) by 0 days.

(21) Appl. No.: 14/940,361

(22) Filed: Nov. 13, 2015

(65) Prior Publication Data

US 2016/0135514 A1 May 19, 2016

(30) Foreign Application Priority Data

Nov. 13, 2014 (GB) ..... 1420212.1

(51) Int. Cl.
*A41C 3/00* (2006.01)
*A41F 1/00* (2006.01)

(52) U.S. Cl.
CPC ..... *A41C 3/0028* (2013.01); *A41C 3/0071* (2013.01); *A41F 1/002* (2013.01)

(58) Field of Classification Search
CPC ..... A41C 3/00; A41C 3/005; A41C 3/0071; A41C 3/06
USPC ..... 450/36, 54–57, 86
See application file for complete search history.

(56) References Cited

U.S. PATENT DOCUMENTS 2,654,091 A * 10/1953 Nelson ..... A41C 1/06 2/73
2,671,218 A * 3/1954 Luhr ..... A41D 7/00 450/22
3,425,420 A * 2/1969 Steinberger ..... A41C 3/0071 450/36
5,938,500 A * 8/1999 Hampton ..... A41C 1/06 2/73
6,199,248 B1 * 3/2001 Akashi ..... A41H 37/001 24/114.6
6,319,092 B1 * 11/2001 Leyhe ..... A41C 3/0071 450/36
8,123,587 B2 * 2/2012 Liegey ..... A41C 3/005 450/1
8,257,140 B2 * 9/2012 Kenny ..... 2/247
2002/0193048 A1 * 12/2002 Kato ..... A41C 3/0071 450/1
2003/0005558 A1 * 1/2003 Wong ..... A41F 1/006 24/303

* cited by examiner

*Primary Examiner* — Gloria Hale
(74) *Attorney, Agent, or Firm* — Renner, Otto, Boisselle & Sklar, LLP

(57) ABSTRACT

A need for a flexible bra that can be worn with multiple different necklines has been identified. Thus there is provided a garment including: a band arranged in use to extend around the torso and two cups attached to the band via a releasable attachment means.

11 Claims, 1 Drawing Sheet

GARMENT

TECHNICAL FIELD

The present disclosure is in the technical field of clothing in particular garments worn for breast support such as brassieres and bikini tops.

BACKGROUND

The market for lingerie and swimwear has developed and increased significantly over the last fifty years with an increasing variety of styles, colours and fabrics now being available. Where previously these garments were worn to cover and support the breasts, the market has developed such that bras and bikini tops are now worn as fashionable as well as functional garments.

In particular the industry has begun to tailor their garments to the clothing with which the bra or bikini top is to be worn. For example it is now common to find bras in a nude fabric such that they do not show underneath clothes made of sheer or semi-transparent material. As another example, strapless bras that do not show under a strapless dress are also in popular demand.

Multiway bras having removable straps that can be worn in a variety of ways are also now generally available. These offer the consumer a single item of clothing for multiple purposes. For example a multiway bra may be worn without the straps with strapless dresses, with only a single strap with clothing with one shoulder strap and with the straps crossing over at the back with racer back tops to name but a few examples.

The market has also seen an increase in the style of cups which support the breast. Plunge bras, t-shirt bras and balconette bras are all offered to co-ordinate with the particular clothing being worn. Stick on bras which include an adhesive or "sticky" portion which adheres to the body are also now regularly included as part of a lingerie brand's offering to be worn with low backed or lace backed dresses for example.

However whilst the industry has developed new designs to keep up with the progress of fashion, most of these different styles are only available in smaller cup sizes for example up to D or E cup. The number of styles available to consumers of size E cup or greater is limited when compared to those available in smaller sizes. This is somewhat of a mismatch since those with a larger bust are more likely to need the support provided by a bra.

Additionally most styles of bra (except the variable strap style discussed above) are unable to be used with a variety of different clothing styles. For example a strapless bra often has a wide band between the breasts and thus is not suitable to be worn with a plunging neckline. Indeed it has even been known for a bra which may be worn successfully with one particular type of plunge neckline for example a cowl neck to be unsuitable for wearing with another type of plunge neckline for example a v-neck or halterneck. Thus it can be the case that each time a new top or dress is bought, a new bra must be bought as well thereby resulting in considerable expense to the consumer.

The present disclosure aims to mitigate these and other issues associated with current bras and bikini tops and additionally provides other technical and commercially advantageous features.

SUMMARY

Aspects of the invention are defined in the accompanying claims.

According to a first aspect there is provided a garment comprising: a band arranged in use to extend around a torso; and two cups attached to the band via a releasable attachment means.

The attachment means may include a first attachment portion located on the band and a second attachment portion located on each of the cups wherein the first and second attachment portions are arranged to cooperate with each other thereby securing the cups to the band.

A breast support garment is therefore provided that may be altered depending on the style of garment worn. In some examples the location of the cups on the band may be altered or in other examples different shaped cups that correspond to a particular neckline may be attached to the band. The provision of a breast support garment where cups may be individually selected also provides advantages where the wearer may require each cup to be a different size. This has particular advantages where the wearer has undergone breast surgery, for example a mastectomy.

The releasable attachment means advantageously allows for the location of the cups to be adjusted depending on the clothing being worn whilst still providing secure location of the cups on the band. Thus the garment provides flexibility to the wearer whilst securely supporting and covering the breasts. The provision of a releasable attachment for the cups enables the cup to be removed completely is f the bra is to be used as a nursing bra. This advantageously allows the cups to be positioned out of the way during nursing.

The first attachment portion may include a plurality of first attachment portions located at a plurality of discrete locations along the length of the band and wherein the second attachment portion may include a plurality of second attachment portions arranged along a lower edge of each of the cups. By providing a plurality of attachment portions at a plurality of different locations, a number of different possible locations for the cups on the band are provided. The attachment portions provide secure location of the cups on the band at each individual location thereby preventing movement of the cups away from the desired location which can lead to embarrassment for the wearer.

By providing a number of different possible locations for the cups on the band, the wearer can adjust the location of the cups depending on the item of clothing worn. This provides advantages in terms of cost saving to the wearer since one garment may be bought to wear with a number of different necklines. Particular advantages are provided with respect to different types of plunging neckline for example halterneck, cowl neck, etc.

Each cup may include a hollow channel at the base of that cup and the band and cups may be arranged such that at least a portion of the band extends through the hollow channel. Thus an additional means of securing the cups to the band is provided.

Each of the first attachment portions may be a magnet and each of the second attachment portions may be a magnetic disc. In an alternative example each of the first attachment portions may be a slit or hole and each of the second attachment portions may be a hook. The attachment means selected advantageously provide little or no visual impact on the overall look of the garment and lie flat against the skin thereby providing a garment that is comfortable to wear as well as providing the flexibility required.

The band and cups may be formed of material containing elastic. The material used contains some elastic to assist in providing support for the breast and to provide a comfortable fit.

Each cup may include a strap. Each strap may be fixed to the cup. The strap may be fixed to the cup by stitching or other fastening or may alternatively be integrally formed with the cup. Alternatively each strap may be removable. Each strap may also be adjustable in length. The garment may advantageously be provided with a single strap or two straps. Each strap being adjustable in length so the user can select the most appropriate length for their size and shape. Alternatively the garment may be provided with multiple strap options thereby providing a garment that gives the wearer flexibility in both the cup location and strap style. Thus a multitude of different style permutations are provided by a single garment thereby providing the wearer with the option of wearing the garment with multiple different designs.

According to a second aspect of the invention there is provided a breast supporting garment including: a pair of breast supporting cups, each cup including a connector arrangement arranged to receive a band and a band; wherein each connector arrangement comprises a plurality of coupling points arranged along a lower edge of the cup and wherein the lower strap comprises a plurality of coupling points arranged to co-operate with the coupling points on the lower edge of each cup so as to allow each cup to be selectively and independently located with respect to the lower strap. Thus a garment is provided that provides the wearer with option to adjust the garment depending on the other clothing it is to be worn with. In particular the garment may be worn with a number of different necklines due to the adjustability of the cup location.

According to a third aspect there is provided a bra kit including: a band, a pair of breast supporting cups, wherein each cup is configured to be releasably attached to the band; and a pair of straps, wherein each strap is configured to be attached to a corresponding cup. The bra may be provided in kit form whereby the wearer may select a particular band and cups depending on their particular size and shape and the clothing the garment is to be worn with.

BRIEF DESCRIPTION OF THE DRAWINGS

The invention will now be described by way of example only with reference to the following drawings in which.

In the Figures like parts are depicted by like reference numerals.

Figure 1:
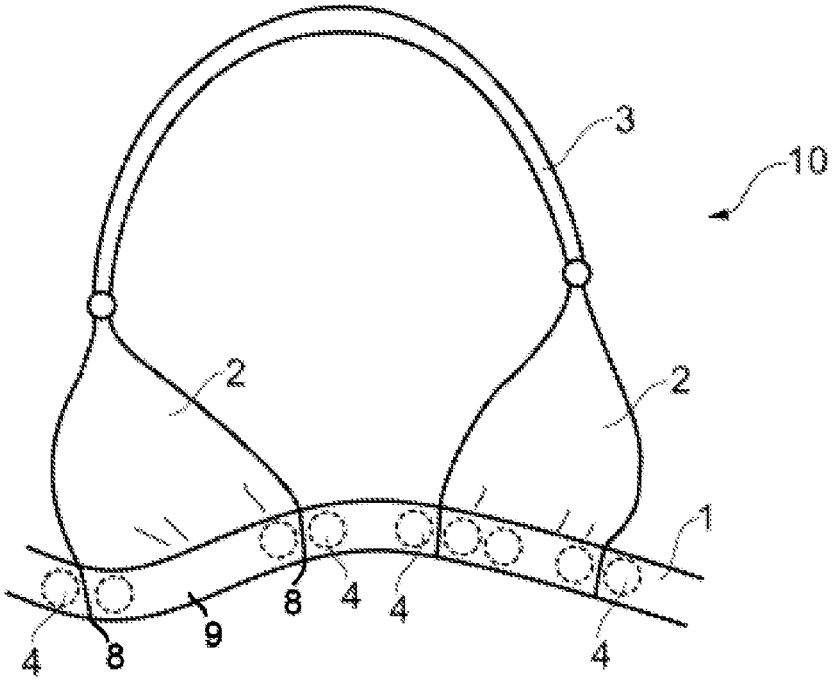
FIG. 1 illustrates a first embodiment of a garment.

While the invention is susceptible to various modifications and alternative forms, specific embodiments are shown by way of example in the drawings and are herein described in detail. It should be understood, however, that the drawings and detailed description of the specific embodiments are not intended to limit the invention to the particular forms disclosed. On the contrary, the invention is intended to cover all modifications, equivalents and alternatives falling within the spirit and scope of the present invention as defined by the appended claims.

DETAILED DESCRIPTION

A breast support garment or bra (10) that can be worn with a variety of different necklines is illustrated in FIG. 1. The garment (10) is formed of a band (1) that in use is worn around the chest just under the breasts. The band is between 2 cm and 3.5 cm wide. In some examples the band is between 2.5 cm and 3 cm wide. The band is formed of a fabric having some elasticity for example lycra or elastane. In some examples the band is formed of a nylon-lycra mix having 71% nylon and 29% lycra. Other suitable fabrics may also be used, for example elastanes, polyamides or polyesters.

In use the two ends of the band fasten at the back via a series of hook and eye fasteners although any other suitable fastener may also be used.

Two substantially triangular shaped cups (2) to support the breasts are releasably attached to the band (1) at the front of the garment (10) using at least one releasable fastening. Each cup is formed of a partially elasticated material which assists in supporting the breast. For example the cups may be formed of the same fabric as the band. Fabrics having some elasticity from which the cups may be formed include for example lycra or elastane. In some examples the band is formed of a nylon-lycra mix having 71% nylon and 29% lycra. Other suitable fabrics may also be used, for example elastanes, polyamides or polyesters.

Each cup (2) is attached to a strap (3) that in use is worn behind the neck thereby providing a halterneck strap (3) such that the garment (10) can be worn with halterneck style dresses or tops. The strap (3) may be removable or alternatively may be fixed to the cups. In some examples the strap is integrally formed with the cups (2), in other examples the strap is sewn to the cup or connected to the cup via a ring or loop. The strap may be adjustable in length thereby providing the wearer with the option of lengthening or shortening the strap according to their preference. The strap is typically made from the same material as the band and cups but may alternatively be made from a different material.

The cups (2) are fastened to the band via a series of releasable fasteners. In the illustrated example the band (1) includes a plurality of magnets (4) located at a plurality of discrete positions along the band. Each cup (2) includes a disc of magnetic material at each lower corner of the cup (2). The magnetic material being such that when the cup (2) is positioned on the band (1) such that the magnet (4) and disc of magnetic material are arranged on top of one another, the magnetic force of attraction between the disc and the magnet retains the cup (2) in position on the band (1). In this disclosure the term magnetic disc is used to refer to any portion of magnetic material having a flat or generally two-dimensional shape.

Each cup (2) can therefore be positioned at a plurality of locations along the band (1) depending on the desired neckline position. Thus when a more plunging neckline is to be worn over the garment (10), the wearer can move the cups further apart to avoid the cups showing. In some examples each entire cup may be moved to a new position on the band. In other examples only one portion of the cup may be moved to a new location. Thus a flexible garment that may be worn with a number of different styles of clothing is provided.

In the present example, the base of each cup (2) includes a double layer of material that is kept open at the edge (8) of the cups thereby providing a casing or hollow channel (9) at the base of the cup (2) through which the band (1) is threaded. The band (1) is thus 5 located within the base of the cup (2) thereby assisting with maintaining the position of the cup (2) with respect to the band (1).

In an alternative example the band (1) and each cup (2) are provided adjacent to or on top of one another such that it is only the magnetic forces of attraction that keep the cups (2) and band (1) together thereby forming the final garment (10).

Although in the example above only two discs formed of magnetic material are described any number of discs may be included on each cup to assist with securing each cup to the band.

In the example described above, the magnets are provided on the band and the magnetic discs on the cups however in some examples the magnets are provided on the cups and the magnetic discs are provided on the band.

In the foregoing example a plurality of magnets located at discrete locations on the band are provided. However in an alternative example, a single larger magnet could be arranged along the length of the band thereby providing a continuous magnet to which the individual magnetic discs attached to the cups may be fastened.

In some examples where a particularly secure fastening is required, particularly magnets such as neodymium magnets may be used.

Figure 2:
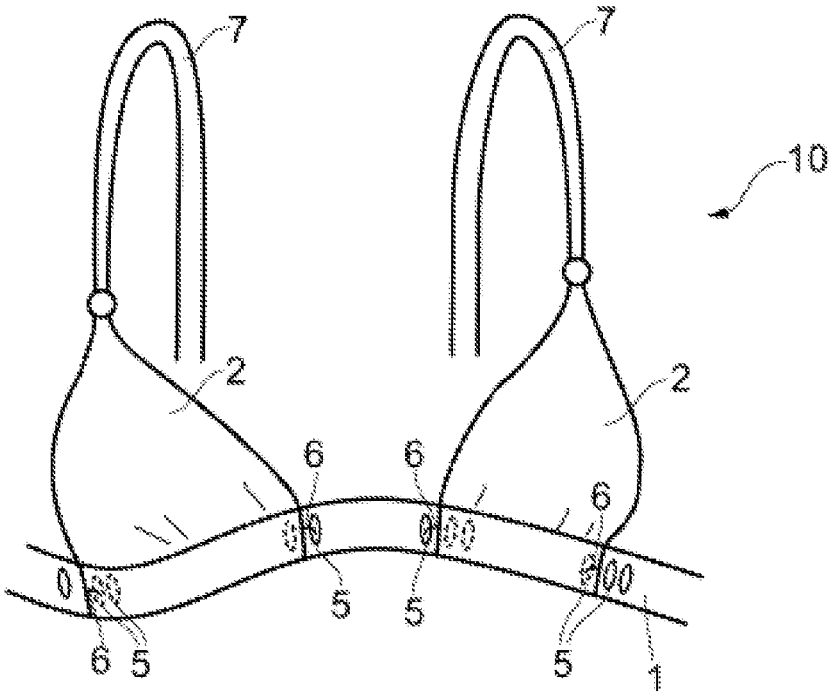
FIG. 2 illustrates a second embodiment of a garment.

FIG. 2 illustrates an alternative embodiment to that shown in FIG. 1. In the following description only the features of this embodiment that are different to the embodiment of FIG. 1 will be described.

In the embodiment of FIG. 2, again the garment (10) includes a band (1) and a pair of cups (2). However in this example instead of a plurality of magnets being located on the band (1) as in the embodiment of FIG. 1 discussed above, a plurality of slits or holes (5) are formed in the material of the band. Each cup includes at least two hooks or buttons (6) at the base of the cup which are arranged to hook or catch on the slits or holes (5). Although only two hooks or buttons (6) are illustrated on each cup in FIG. 2, it will be appreciated that any suitable number of hooks or buttons (6) may be used in order to securely fasten the cups (2) to the band (1). Thus an alternative means of attaching the cups (2) to the band (1) has been described.

A further difference between the embodiment of FIG. 2 and the embodiment of FIG. 1 is the straps (7). In the example of FIG. 2 each cup (2) includes a single strap (7) extending from the top of the cup (2) to the band (1) such that in use each strap (7) passes over the shoulder of the wearer and is fastened to the band (1) at the back. Thus a more conventional strap arrangement is envisaged. The straps may be adjustable in length thereby providing the wearer with the option of lengthening or shortening the strap according to their preference.

Although two different strap arrangements have been described with reference to FIGS. 1 and 2 above, it will be appreciated that the garment could include any suitable straps such as, for example multiway straps that provide multiple strap arrangements.

Although in the examples described with reference to FIGS. 1 and 2, substantially triangular cups are illustrated, it will be appreciated that any suitable cup shape may be used.

In the examples described above, two methods of attaching the cups (2) to the band (1) have been described. However it will be appreciated that other means of attachment that provide discrete or continuous attachment means along the length of the band are also envisaged. For example, press studs, buttons, hook and loop fasteners such as Velcro, or any other suitable means that enables the cups to be selectively removable from the band may be used. In particular fastenings that can provide a plurality of positions for secure attachment of the cups to the band whilst having a discreet appearance are envisaged.

Thus a garment (10) has been described where the neckline can be repositioned depending on the clothing to be worn with the garment (10).

The invention claimed is:

1. A breast supporting garment comprising:

a pair of breast supporting cups, each cup comprising a connector arrangement arranged to receive a band; and a band; wherein each connector arrangement comprises a plurality of cup coupling points arranged along a lower edge of the cup and wherein the band comprises a plurality of band coupling points arranged to co-operate with the coupling points on the lower edge of each cup so as to allow each cup to be selectively and independently located with respect to the band at a plurality of different locations on the band.

2. A garment according to claim 1 wherein each of the band coupling points comprises a magnet and each of the cup coupling points comprises a magnetic disc.

3. A garment according to claim 1 wherein each of the band coupling points comprises a slit or hole and each of the cup coupling points comprises a hook or button.

4. A garment according to claim 1 wherein each cup comprises a hollow channel at the base of that cup and the band and cups are arranged such that at least a portion of the band extends through the hollow channel.

5. A garment according to claim 1 wherein the band and cups are formed of material containing elastic.

6. A garment according to claim 1 wherein each cup comprises a strap.

7. A garment according to claim 6 wherein the strap is fixed to the cup.

8. A garment according to claim 7 wherein the strap is integrally formed with the cup.

9. A garment according to claim 6 wherein the strap is removable.

10. A garment according to claim 6 wherein the strap is adjustable in length.

11. A breast supporting cup for use in a garment according to claim 1 wherein the cup comprises a releasable attachment means along the lower edge of the cup.

* * * * *